US005802973A

United States Patent [19]

Mueller et al.

[11] Patent Number: 5,802,973

[45] Date of Patent: Sep. 8, 1998

[54] DEVICE FOR REGISTER ADJUSTMENT ON A SHEET-FED PRINTING PRESS

[75] Inventors: Tobias Mueller, Hirschberg; Anton Rodi, Leimen; Klaus Mueller, Heidelberg; Holger Leonhardt, Bammental, all of Germany

[73] Assignee: Heidelberger Druckmaschinen Aktiengesellschaft, Heidelberg, Germany

[21] Appl. No.: 542,298

[22] Filed: Oct. 12, 1995

Related U.S. Application Data

[63] Continuation of Ser. No. 141,123, Oct. 21, 1993, abandoned.

[30] Foreign Application Priority Data

Oct. 21, 1992 [DE] Germany ..... 42 35 393.9

[51] Int. Cl.[6] ..... B41F 5/02; B41F 13/12

[52] U.S. Cl. ..... 101/183

[58] Field of Search ..... 101/181, 183, 101/DIG. 45, 484, 485; 250/571, 226

[56] References Cited

U.S. PATENT DOCUMENTS

| | | |
|---|---|---|
| 3,832,557 | 8/1974 | Bazhuun et al. . |
| 4,485,447 | 11/1984 | Ericsson . |
| 4,857,745 | 8/1989 | Gough . |
| 5,138,667 | 8/1992 | Roch et al. . |

FOREIGN PATENT DOCUMENTS

| | | |
|---|---|---|
| 0289206 | 11/1988 | European Pat. Off. . |
| 0401691 | 12/1990 | European Pat. Off. . |
| 1423576 | 1/1969 | Germany . |
| 2539481 | 5/1976 | Germany . |
| 2848963 | 8/1979 | Germany . |
| 3529821 | 4/1986 | Germany . |
| 3707866 | 10/1987 | Germany . |
| 3015159 | 9/1989 | Germany . |
| 3811359 | 10/1989 | Germany . |
| 2188171 | 9/1987 | United Kingdom . |
| 2218046 | 11/1989 | United Kingdom . |
| 9101847 | 2/1991 | WIPO . |

OTHER PUBLICATIONS

Register–und Einzelstrangsteuerung an Rollenmaschinen, Druckwelt 19, Oct. 10, 1992.

*Primary Examiner*—J. Reed Fisher
*Attorney, Agent, or Firm*—Herbert L. Lerner; Laurence A. Greenberg

[57] ABSTRACT

Register adjustment device in a sheet-fed printing press having adjusting elements for adjusting a printing operation thereof includes a position sensor, a light source for supplying light to the position sensor, and an evaluating unit connected to the position sensor for receiving data therefrom regarding registration of printing material traveling on a path through the printing press, and the evaluating unit being further connected to the adjusting elements of the printing press for adjusting a printing operation thereof in accordance with the data, the position sensor being disposed in the vicinity of the printing-material travel path so as to determine a respective register affecting the printing material, the position sensor having at least two sensor heads disposed at spaced distances from one another; and a method of register-adjustment.

15 Claims, 3 Drawing Sheets

DEVICE FOR REGISTER ADJUSTMENT ON A SHEET-FED PRINTING PRESS

This application is a continuation of application Ser. No. 08/141,123, filed Oct. 21, 1993 now abandoned.

SPECIFICATION

The invention relates to a device and method for register adjustment on a sheet-fed printing press and, more particularly, for circumferential, side, closely-spaced, fanned-out or widely-spaced, and/or diagonal register adjustments, with an optical position sensor, an illumination source and an evaluation unit, the adjustment or setting data of which are fed to adjusting members of the register-adjusting device.

From the published European Patent Application 0 289 206, a web press has become known heretofore having a printing-material web which is irradiated by a light source in order to detect reflections of light from markings which are disposed in series, i.e., behind one another. The travel speed of the printing-material web and the position of the printing-material web transverse to the travel direction thereof can thereby be determined.

Register-adjusting devices of the foregoing general type have become known heretofore. The operator, such as a pressman, removes a printed sheet from the sheet-fed printing press and lays it on an evaluation table of a conventional device separated from the sheet-fed printing press and having the capability of detecting the positions of imprinted register markings and determining adjustment values by means of an evaluation unit. The adjustment values are then introduced by the operator into the sheet-fed printing press so as to effect side and/or diagonal register adjustments. An automatic adjustment of these determined adjustment values in off-line operation is also possible. In a corresponding manner, a closely or widely-spaced register correction can, moreover, be effected. This operation requires a great amount of experience and tactile sensitivity or instinct, so that only highly qualified personnel may be used. The success of the adjustment operation is not always assured within brief change-over times.

It is accordingly an object of the invention to provide a device and method for register adjustment on a sheet-fed printing press of the foregoing general type by which make-ready or setting times of the sheet-fed printing press is shortened, and which is, furthermore, of relatively simple and functionally reliable construction and is usable many times over.

With the foregoing and other objects in view, there is provided, in accordance with one aspect of the invention, a register adjustment device in a sheet-fed printing press having adjusting elements for adjusting a printing operation thereof, comprising a position sensor, a light source for supplying light to the position sensor, and an evaluating unit connected to the sensor for receiving data therefrom regarding registration of printing material traveling on a path through the printing press, the evaluating unit being further connected to the adjusting elements of the printing press for adjusting a printing operation thereof in accordance with the data, the position sensor being disposed in the vicinity of the printing-material travel path so as to determine a respective register affecting the printing material, the position sensor comprising at least two sensor heads disposed at spaced distances from one another.

Due to the arrangement of the position sensor in the vicinity of the printing-material travel path of the printing press, no additional separate device is required to determine the register data. On the contrary, in so-called in-line operation, a position determination and, after the evaluation of the determined data, an automatic adjustment is possible. In contrast with the state of the art, the adjustment data determined by the evaluating unit are not introduced by the operating personnel into the sheet-fed printing press, but rather, are fed as adjustment commands to adjusting elements for an automatic register adjustment of the sheet-fed printing press in the in-line operation mode. Because at least two sensor heads disposed at spaced distances from one another are provided, various printing-material marks or the like can be detected or determined simultaneously, in a relatively simple manner, due to which, for example, diagonal register errors are clearly determinable and correctible, so that a reliable and exceptionally rapidly reacting correction occurs. As aforementioned, the register adjustments are performed during the printing operation, so that a continual correction is assured for deviations which occur. Influences or effects resulting from deformations of the printing material and which affect the printing result are determinable by means of the device according to the invention likewise in the in-line operation mode, and can be evaluated and, if necessary or desirable, corrected promptly.

In accordance with another feature of the invention, means are provided for driving the sensor heads independently of one another transversely to a direction of the travel of the printing material on the travel path thereof. The drivability of the sensor heads permits an alignment of the sensor heads to the location of the register and marks, respectively, of the sheet of the printing material. Moreover, the positions of the sensor heads are able to be matched or adjusted to the sensor heads of the respectively used sheet format, in a relatively simple manner. Marks which are disposed in series, i.e., behind one another, on a printed sheet, are detected by the sensor heads during the printing operation due to the travel movement of the printing material. In that respect, a sensor-head shift occurs only in the course of the alignment operation, before any actual printing start, and not, however, during the printing operation. The shifting of the sensor heads preferably occurs automatically. Only if the side register were to be adjusted would it be necessary to shift the sensor head also during the printing operation.

In accordance with a further feature of the invention, an hermetically sealed sensor housing is provided wherein the sensor heads are received, the sensor housing having at least one window formed of translucent material through which light rays from the light source via the sensor heads are directable outwardly onto the printing material and are reflectable from the printing material inwardly to the respective sensor heads. The arrangement of the two sensor heads in the closed sensor housing ensures a trouble-free operation, because the sensitive sensor heads are shielded and, accordingly, not subject to any soiling or the like. Care must be taken only that the window which permits the exit of light rays of the illumination source and, simultaneously, also the entrance of the reflected light is kept clean.

The aforementioned window, which is preferably formed of glass or transparent plastic material, can either be unipartite and thus permit the exiting and entering light to pass, or can be of bipartite construction, so that part of the window is used for exiting the light rays, and the reflected light enters through the other part of the window. The hermetic sealing of the sensor housing always ensures the protection of the sensitive parts.

In accordance with an added feature of the invention, a driving device is disposed in the sensor housing for driving the sensor heads. This permits the aforementioned automatic alignment of the sensor heads with the regions of the printed sheet which are to be detected.

In accordance with an additional feature of the invention, the sensor housing is an elongated bar-shaped structure extending parallel to a disposition of respective leading edges of sheets traveling on the travel path of the printing material. The bar shape requires only a small amount of space and therefore offers no disruptive presence in the printing-material travel path.

In accordance with yet another feature of the invention, the illumination source is a cold light source.

In accordance with yet a further feature of the invention, the cold light source is a cold white light source.

In accordance with yet an added feature of the invention, the register adjustment device includes a sensor housing wherein the sensor heads are received, a lamp housing wherein the illumination source is received, and a light-wave conductor connecting the lamp housing to the sensor housing.

This construction leads to being able to provide the sensor housing with very small dimensions, because the illumination source does not have to be located at the location of the sensor heads, i.e., not directly in the vicinity of the printing-material travel path. Rather, the illumination source can be disposed at a suitable location not critical with respect to space requirement, the light transmission to the sensor housing being effected over the light-wave conductor, which has only very small dimensions and, moreover, is flexible, so that it can pass poorly accessible and/or narrow regions, also without any problem.

In accordance with yet an additional feature of the invention, the light-wave conductor connects the lamp housing to the sensor heads received in the sensor housing.

In accordance with still another feature of the invention, the register adjustment device includes a lamp housing wherein the illumination source is received, the illumination source being energizable for emitting radiation along a radiation path within the lamp housing, and a selectively operating beam splitter disposed in the radiation path for separating visible light from infra-red radiation out of the radiation emitted by the illuminating source. The beam splitter permits visible light to pass, and reflects infrared radiation, or vice versa.

In accordance with still a further feature of the invention, the beam splitter is one of a wave-length selective mirror and an infra-red suppression filter.

The illumination source which generates white light of high intensity and is formed, preferably, as a halogen or gas-discharge lamp, radiates not only the desired white light, but also, a considerable amount of heat which, due to the beam splitter, is transmitted out of the lamp housing, so that, although the lamp housing may be hermetically sealed, nevertheless no overheating occurs.

In accordance with still an added feature of the invention, the lamp housing is formed with a window for transmitting therethrough the infra-red radiation which is reflected from the beam splitter. The visible light passing through the beam splitter arrives likewise at a window, for example, formed of glass or transparent plastic material, and then transmitted therefrom to the light-wave conductor. It is also possible to insert the light-wave conductor into the lamp housing by passing it through an hermetically sealed threaded coupling.

In accordance with still an additional feature of the invention, a reflector formed as an ellipsoidal mirror is disposed in the lamp housing for focusing the light from the illumination source and directing it to the light-wave conductor. Alternatively, it is also possible to provide a reflector which generates only parallel light which is focused by imaging or focusing optics and then arrives at the light-wave conductor.

In accordance with another feature of the invention, a control device is provided having a control circuit wherein the evaluating device, the position sensor serving as an actual-value transmitter, and at least one actuator for the adjusting elements of the printing press are connected. This actuator effects the register adjustments by adjusting the adjusting elements. The construction as a control circuit closed in itself affords especially good printing results, because any occurring deviations are always controlled or stabilized, providing high precision.

In accordance with a further feature of the invention, the position sensor is capable of determining adjustment values of one of a closely-spaced and a widely-spaced register from marks present on the printing material and of feeding the adjustment values to the at least one actuator for the adjusting elements. The actuator may cooperate, for example, with a divided clamping or locking bar of a printing-plate cylinder for clampingly acting upon a printing plate. Deformations of the printing material during the printing process result in locally-dependent register errors in the printed product, which are determined automatically by the position sensor due to the closer or wider printing correction, and are removed, preferably controllingly or by stabilization, by suitably influencing the printing plate.

In accordance with another aspect of the invention, there is provided a method of adjusting the register of a printing sheet in a sheet-fed printing press, which comprises the steps of determining optically a respective register mark on a printing material, and applying the determined results for automatically mechanically adjusting the register.

In accordance with a further mode of the method of the invention, the determining step includes optically detecting marks distributed over the surface of a sheet of the printing material and determining therefrom printing-material influences affecting printing results, and evaluating the positions of the marks.

In accordance with an added mode of the method of the invention, marks disposed in corner regions of the respective sheet are optically detected in the determining step. Because at least two sensor heads are always provided, the two marks in the corner regions of the leading edge and in the corner regions of the trailing, respectively, of the sheet are able to be detected simultaneously.

In accordance with an additional mode of the method of the invention, the printing-material influences are at least one of sheet-lengthening, blooming of the sheet transversely to the direction of printing, closely-spaced printing and widely-spaced printing.

In accordance with a concomitant mode of the method of the invention, the register being adjusted is at least one of circumferential, side, closely-spaced, widely-spaced and diagonal registers.

Other features which are considered as characteristic for the invention are set forth in the appended claims.

Although the invention is illustrated and described herein as embodied in a device and method for register-adjustment in a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
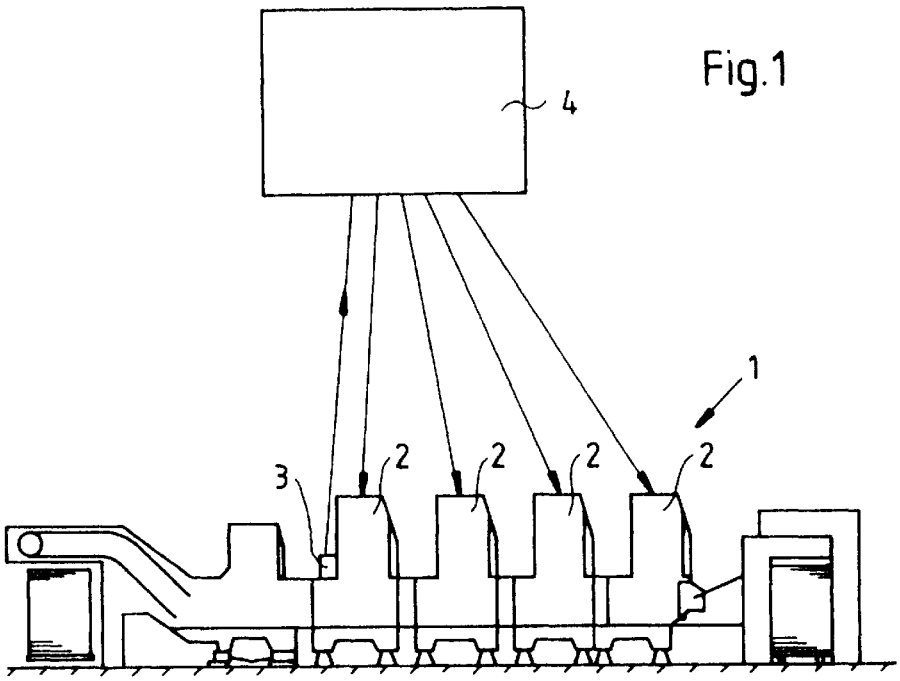
FIG. 1 is a diagrammatic side elevational view of a sheet-fed rotary printing press showing schematically a register adjusting device according to the invention connected thereto.

Referring now to the drawing and, first, particularly to FIG. 1 thereof, there is shown therein a sheet-fed rotary printing press 1 with several printing units 2, namely four, in this embodiment. A position sensor 3 is assigned to a last one of the printing units 2, as viewed in printing direction from the right-hand side towards the left-hand side of FIG. 1, and is connected to an impression cylinder of the aforementioned last one of the printing unit 2 in the travel path of the printing material in sheet-fed printing press. The position sensor 3 belongs to a register-adjusting device which affords circumferential, side, closely-spaced, widely spaced, and/or diagonal register adjustments. Data determined by the position sensor are fed to an evaluation unit 4 which, in turn, determines adjustment values and/or adjustment commands and feeds them to the individual printing units 2 for corresponding mechanically or automatically occurring register adjustment.

Figure 2:
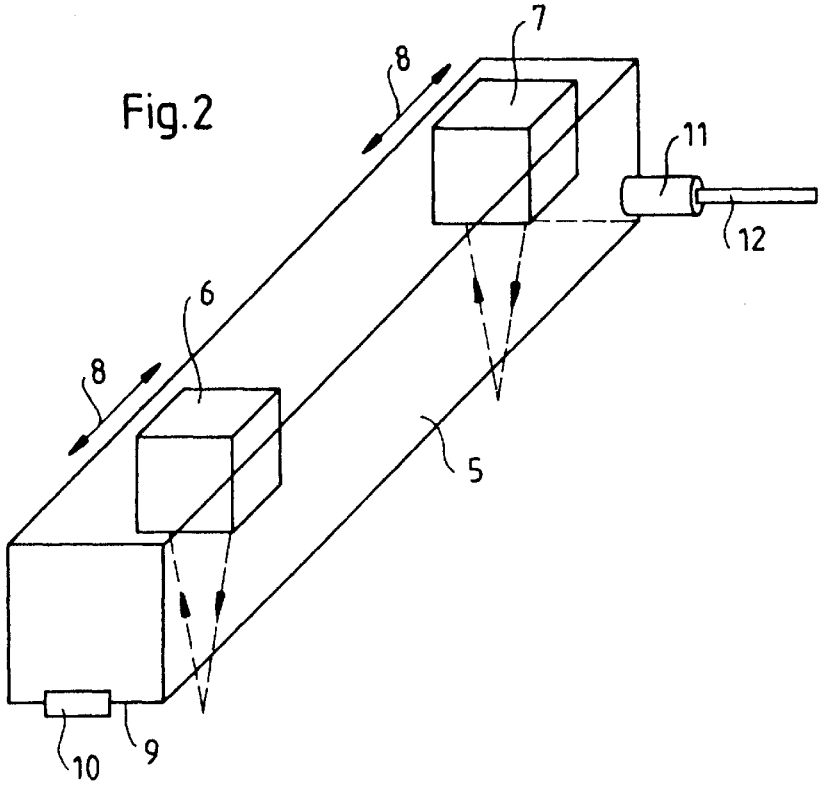
FIG. 2 is a diagrammatic perspective view of a pair of sensor heads of the adjusting device which are disposed in a strip or bar-shaped, hermetically sealed sensor housing.

FIG. 2 shows the position sensor 3 in a diagrammatic view. Illustrated therein is an hermetically-sealed, strip or bar-shaped sensor housing 5 wherein two sensor heads 6 and 7 are capable of travelling in the longitudinal direction of the sensor housing 5. Conventional guides necessary for facilitating the travel capability of the sensor heads 6 and 7 are not shown in FIG. 2, in the interest of clarity. This applies as well to a conventional non-illustrated driving device which affords a positioning of the sensor heads 6 and 7 independently of one another. The travel capability of the sensor heads 6 and 7 is represented by double-headed arrows 8 in FIG. 2. A window 10 formed of a translucent material, such as glass, especially, is installed in a bottom wall 9 of the sensor housing 5, and may extend over the entire length of the housing 5. Light rays issuing from the sensor heads 6 and 7 can pass through the window and impinge upon the printing material therebelow. This may occur during the operation of the sheet-fed printing press 1. Light reflected from the sheet passes through the window 10 in the opposite direction and returns to the respective sensor head 6, 7. Thus, each of the sensor heads 6 and 7 has a light transmitter as well as a light receiver or detector. The incident and emergent light rays are represented by arrows shown in broken lines in FIG. 2. The sensor housing 5 is, furthermore, provided with a hermetically-sealed pass-through or lead-in 11 through which a connecting cable 12 containing electrical and optical connecting lines extends.

Figure 3:
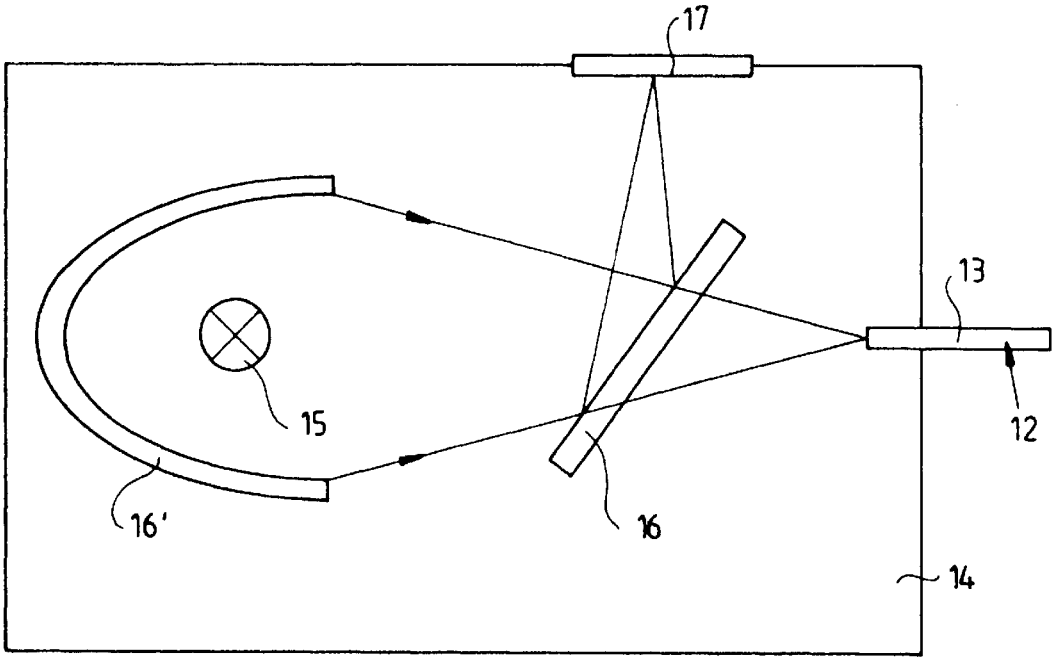
FIG. 3 is a diagrammatic view of a lamp housing for making-ready white light for the sensor heads.

The connecting cable 12 has a light-wave conductor 13 which, as shown in FIG. 3, extends to a lamp housing 14 which is hermetically sealed and shelters an illumination source 15. The illumination source 15, which may be formed as a halogen or as a glow or gas-discharge lamp, generates white light of high intensity. A reflector 16' formed as an ellipsoidal mirror concentrates or focuses the light waves of the illumination source 15 and feeds them to the light-wave conductor 13. In the path of the light rays of the illumination source 15 and within the lamp housing 14, there is disposed a wavelength-selectively operating light-beam splitter 16, which is formed as a "semi-translucent mirror" or as an infra-red suppression filter (IR-suppression filter). Radiation in the visible range, i.e;, light rays, pass through the beam splitter 16; heat rays, i.e., IR-radiation, are reflected by the beam splitter 16 and fed to an exit window 17 of the lamp housing 14 which is penetrable by the heat radiation. Alternatively, it is possible also for the heat radiation to pass through the beam splitter 16, and the visible light to be reflected therefrom, in which case then the positions of the exit window and the beam splitter are interchanged. Heat energy of the illumination source 15 is thereby eliminated, i.e., discharged to the surroundings, so that the inner temperature, in spite of the hermetical sealing of the lamp housing 14, does not increase to unduly high values. In this way it is possible to transmit cold white light via the light-wave conductor 13 to the sensor heads 6 and 7. The local separation of the sensor housing 5 and the lamp housing 14 offers the advantage that, in the vicinity of the printing-material travel path of the sheet-fed printing press 1, only the parallelepipedal or bar-shaped sensor housing 5 must be disposed, whereas the lamp housing 14 can be located at a position in the sheet-fed printing press 1 which is less critical as to space or location. Furthermore, due to the aforedescribed construction, a heat supply directly in the printing region is avoided.

Figure 4:
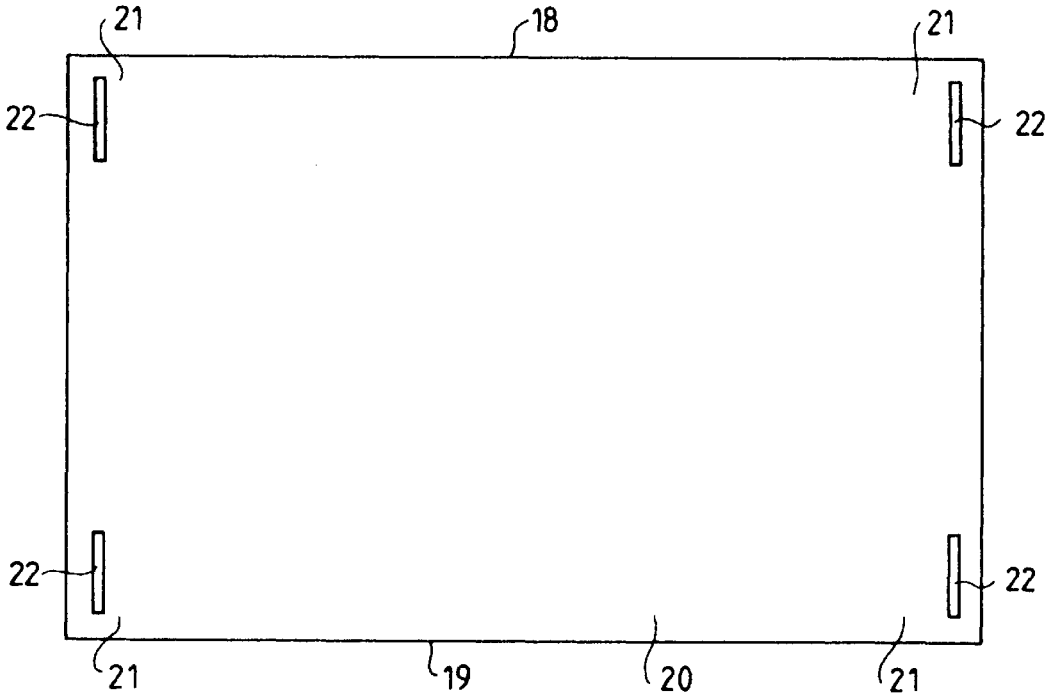
FIG. 4 is a top plan view of a printing sheet having register and position marks, respectively, in corner regions thereof.

FIG. 4 is a top plan view of a sheet 20 for the sheet-fed printing press. The sheet 20 has a leading edge 18, a trailing edge 19 and respective corner regions 21. Marks 22, such as measurement marks and register marks, are arranged in the corner regions 21 and are detected by the sensor heads 6 and 7 of the position sensor 3 during the printing operation. Both of the sensor heads 6 and 7 position themselves automatically so that they can detect or determine the presence of the marks 22 optically without any trouble. As a result of the transport of the sheet 20 in the printing-material travel path of the sheet-fed printing press 1, the marks 22 disposed in the vicinity of the leading edge 18 of the sheet 20 are initially moved past the sensor heads 6 and 7 and, then, the marks 22 lying in the vicinity of the trailing edge 19 of the sheet 20 are so moved. In the course thereof, deviations in register with respect to the circumferential, side, closely-spaced, widely-spaced and/or diagonal register are recognized. The evaluation unit processes the data of existing register deviations of the individual printing units 2 which are determined by the position sensor 3, and issues corresponding adjustment commands resulting in a correction. This occurs fully automatically. By means of suitable non-illustrated actuators, the corresponding components of the sheet-fed printing press 1 are started-up or controlled so as to perform the register adjustments.

Figure 6:
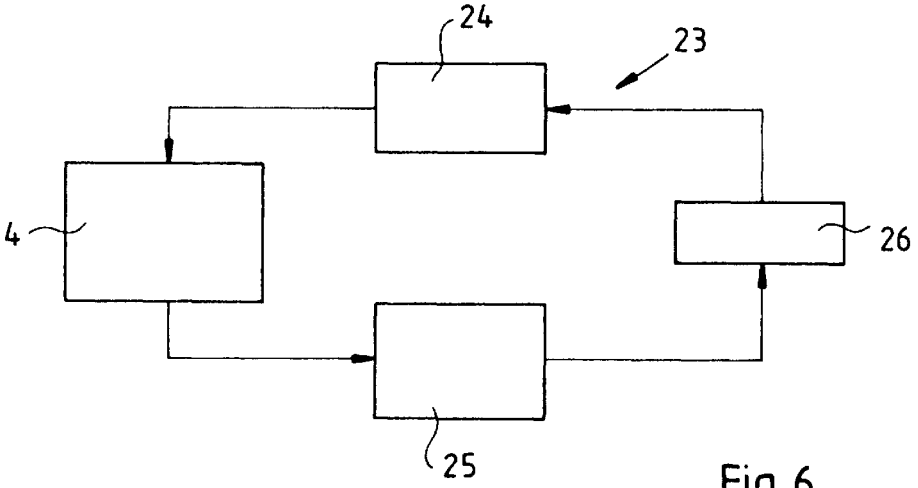
FIG. 6 is a diagram of a control circuit in block form of the register-adjusting device according to the invention.

According to FIG. 6, a control circuit 23 is provided to carry out the register adjustments. An actual-value transmitter 24 determines the actual position value of the register position mark on the sheet 20. The position sensor 3 may thus be the actual-value transmitter 24. The data derived thereby are fed to the evaluation unit 4 wherein the nominal or setpoint value is compared with the actual value, and corresponding adjustment elements, i.e., namely actuators, such as electric motors, for example, are started up or suitably controlled in accordance with the comparison results. The adjustment elements have an effect upon the respective printing units and the printing process 26, the parameters of which, in turn, have an effect upon the actual-value transmitter 24. In this manner, not only register deviations are registered, but also effects upon the printing material are determined, so that disturbances which have an effect upon the printing results, such as sheet lengthening, blooming or rolling down of the sheet transversely to the direction of printing, and the like, are recognized and are controlled or stabilized.

Figure 5:
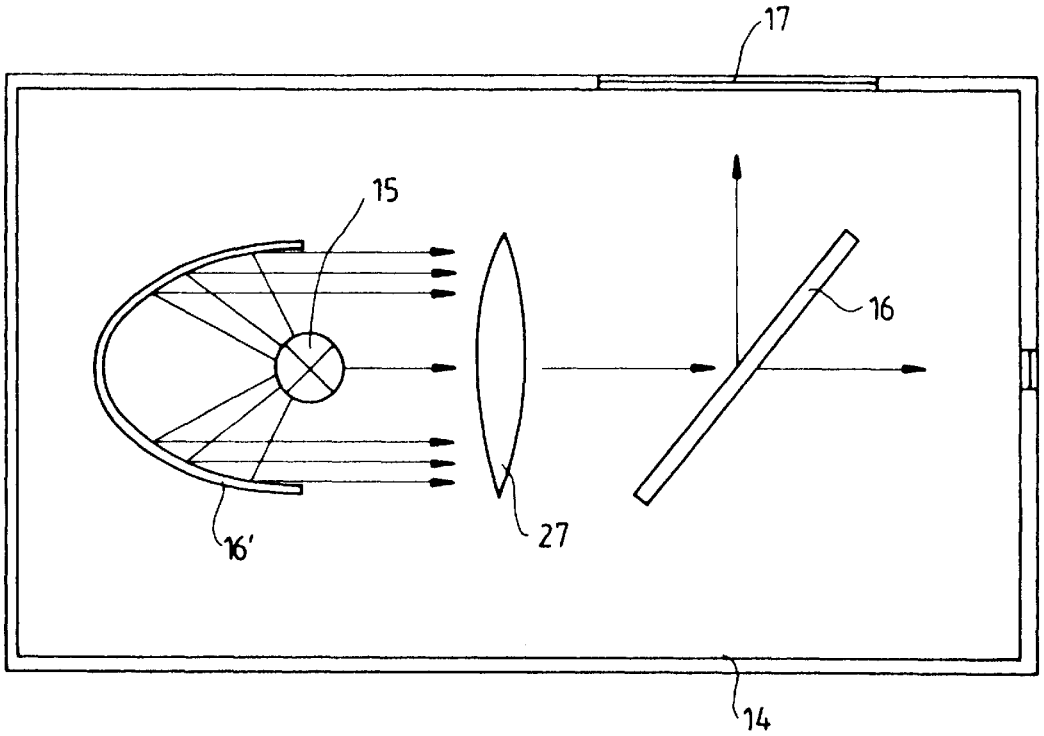
FIG. 5 is a view like that of FIG. 3 of another embodiment of the lamp housing.

Another embodiment of a lamp housing 14 according to the invention is shown in FIG. 5 and differs from the embodiment of FIG. 3 in that a focussing or imaging optical system 27, for example, in the form of a condenser or converging lens, is disposed between the beam splitter 16 and the reflector 16. The reflector 16' directs the rays of light from the illumination source 15 in parallel paths to the focusing optical system 27 which performs a focusing of the light rays, so that a focused light beam can then be supplied to the light-wave conductor 13. It is possible that visible light may be coupled directly into the light-wave conductor or initially directed to an exit window and then to the light-wave conductor.

We claim:

1. Register adjustment device in a sheet-fed printing press having adjusting elements for adjusting a printing operation thereof, comprising a position sensor, a light an illumination source for supplying light to said position sensor, and an evaluating unit connected to said sensor for receiving data therefrom regarding registration of printing material traveling on a path through the printing press, said evaluating unit being further connected to the adjusting elements of the printing press for adjusting a printing operation thereof in accordance with said data, said position sensor being disposed in the vicinity of the printing-material travel path so as to determine a respective register affecting the printing material, said position sensor comprising at least two sensor heads disposed at spaced distance from one another, wherein said position sensor includes a sensor housing for receiving said sensor heads, a lamp housing spaced apart from said sensor housing wherein said illumination source is received, and a lightwave conductor connecting said lamp housing to said sensor housing.

2. Device according to claim 1, including means for driving said sensor heads independently of one another transversely to a direction of the travel of the printing material on the travel path thereof.

3. Device according to claim 1, wherein said sensor housing is hermetically sealed, said sensor housing having at least one window formed of translucent material through which light rays from the illumination source via said sensor heads are directable outwardly onto the printing material and are reflectable from the printing material inwardly to the respective sensor heads.

4. Device according to claim 3, including a driving device disposed in said sensor housing for driving said sensor heads.

5. Device according to claim 3, wherein said sensor housing is an elongated bar-shaped structure extending parallel to a disposition of respective leading edges of sheets traveling on the travel path of the printing material.

6. Device according to claim 1, wherein said illumination source is a cold light source.

7. Device according to claim 6, wherein said cold light source is a cold white light source.

8. Device according to claim 1, wherein said light-wave conductor connects said lamp housing to said sensor heads received in said sensor housing.

9. Device according to claim 1, wherein said illumination source is energizable for emitting radiation along a radiation path within said lamp housing, and a selectively operating beam splitter disposed in said radiation path for separating visible light from infra-red radiation out of the radiation emitted by said illumination source.

10. Device according to claim 9, wherein said beam splitter is one of a wave-length selective mirror and an infra-red suppression filter.

11. Device according to claim 9, wherein said lamp housing is formed with a window for transmitting therethrough the infra-red radiation which is reflected from said beam splitter.

12. Device according to claim 1, including a reflector formed as an ellipsoidal mirror disposed in said lamp housing for focusing the light from said light source and directing it to said light-wave conductor.

13. Device according to claim 1, including a control device having a control circuit wherein said evaluating device, said position sensor serving as an actual-value transmitter, and at least one actuator for the adjusting elements of the printing press are connected.

14. Device according to claim 13, including determining means connected with said position sensor, said determining means operative for determining adjustment values of one of a closely-spaced and a widely-spaced register from marks present on the printing material and for feeding said adjustment values to said at least one actuator for the adjusting elements.

15. Register adjustment device in a sheet-fed printing press having adjusting elements for adjusting a printing operation thereof, comprising a position sensor, an illumination source for supplying light to said position sensor, and an evaluating unit connected to said sensor for receiving data therefrom regarding registration of printing material traveling on a path through the printing press, said evaluating unit being further connected to the adjusting elements of the printing press for adjusting a printing operation thereof in accordance with said data, said position sensor being disposed in the vicinity of the printing-material travel path so as to determine a respective register affecting the printing material, said position sensor comprising at least two sensor heads disposed a spaced distance from one another, wherein said position sensor includes a sensor housing for receiving said sensor heads, a lamp housing wherein said illumination source is received, and a lightwave conductor connecting said lamp housing to said sensor housing, a reflector formed as an ellipsoidal mirror disposed in said lamp housing for focusing the light from said illumination source and directing it to said light-wave conductor, determining means connected with said position sensor, said determining means operative for determining adjustment values from a respective closely-spaced and a widely-spaced register mark from register marks present on the printing material and for feeding said adjustment values to said at least one actuator for the adjusting elements.

* * * * *